US010333243B2

(12) United States Patent
Tang et al.

(10) Patent No.: US 10,333,243 B2
(45) Date of Patent: Jun. 25, 2019

(54) ELECTRICAL CONNECTOR HAVING A TERMINAL MODULE SUPPORTED BY AN INSULATIVE HOUSING AND A SHIELDING SHELL

(71) Applicant: FOXCONN INTERCONNECT TECHNOLOGY LIMITED, Grand Cayman (KY)

(72) Inventors: Zhi-Hui Tang, Kunshan (CN); Jun-Hua Hu, Kunshan (CN); Chih-Ching Hsu, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/892,742

(22) Filed: Feb. 9, 2018

(65) Prior Publication Data

US 2018/0241148 A1 Aug. 23, 2018

(30) Foreign Application Priority Data

Feb. 21, 2017 (CN) ..... 2017 1 0093190

(51) Int. Cl.

| | |
|---|---|
| ***H01R 13/516*** | (2006.01) |
| ***H01R 12/70*** | (2011.01) |
| ***H01R 13/502*** | (2006.01) |
| ***H01R 13/6594*** | (2011.01) |
| ***H01R 12/72*** | (2011.01) |
| ***H01R 13/6581*** | (2011.01) |
| ***H01R 24/64*** | (2011.01) |
| *H01R 13/717* | (2006.01) |

(Continued)

(52) U.S. Cl.

CPC ..... *H01R 13/516* (2013.01); *H01R 12/7011* (2013.01); *H01R 12/724* (2013.01); *H01R 13/502* (2013.01); *H01R 13/6581* (2013.01); *H01R 13/6594* (2013.01); *H01R 24/64* (2013.01); *H01R 13/6658* (2013.01); *H01R 13/719* (2013.01); *H01R 13/7175* (2013.01)

(58) Field of Classification Search

CPC ..... H01R 13/516; H01R 12/7011; H01R 12/724; H01R 13/502; H01R 13/6205

USPC ..... 439/38

See application file for complete search history.

(56) References Cited

U.S. PATENT DOCUMENTS 6,102,741 A * 8/2000 Boutros ..... H01R 13/6633 336/107

6,319,062 B1 * 11/2001 Ma ..... H01R 24/64 439/490

(Continued)

FOREIGN PATENT DOCUMENTS

CN 103457093 12/2013

*Primary Examiner* — Tulsidas C Patel

*Assistant Examiner* — Peter G Leigh

(74) *Attorney, Agent, or Firm* — Wei Te Chung; Ming Chieh Chang

(57) ABSTRACT

An electrical connector includes: an insulative housing; a terminal module received by the insulative housing, the terminal module including an insulator, a plurality of terminals, and an internal, horizontal printed circuit board (PCB) carrying plural magnetic components; and a shielding shell enclosing the insulative housing and the PCB, wherein the insulative housing has a pair of restraining slots receiving a front of the insulator, and the shielding shell has a pair of abutting arms received between the insulator and the PCB.

16 Claims, 7 Drawing Sheets

(51) Int. Cl.
*H01R 13/66* (2006.01)
*H01R 13/719* (2011.01)

(56) References Cited

U.S. PATENT DOCUMENTS 6,328,595 B1 * 12/2001 Chang ..... H01R 13/6641 439/490
6,354,884 B1 * 3/2002 Yeh ..... H01R 13/645 439/296
6,533,436 B2 * 3/2003 Krietzman ..... E05B 17/103 362/183
6,685,504 B1 * 2/2004 Espenshade ..... H01R 13/6594 439/541.5
6,984,155 B1 * 1/2006 Liu ..... H01R 13/6658 439/490
7,040,927 B1 * 5/2006 Liu ..... H01R 24/64 439/490
7,074,083 B2 * 7/2006 Hyland ..... H01R 13/6658 439/607.01
7,241,181 B2 * 7/2007 Machado ..... H01R 13/514 439/541.5
7,416,442 B1 * 8/2008 Liu ..... H01R 24/64 439/540.1
7,645,165 B2 * 1/2010 Wu ..... H01R 13/6582 439/607.38
7,648,390 B2 * 1/2010 Zhang ..... H01R 27/02 439/541.5
7,661,994 B2 * 2/2010 Machado ..... H01R 13/514 439/541.5
7,786,009 B2 * 8/2010 Machado ..... H01R 13/514 438/676
8,403,701 B2 * 3/2013 Han ..... H01R 13/6594 439/541.5
8,439,711 B2 * 5/2013 Wang ..... H01R 24/64 439/676
9,130,329 B1 * 9/2015 Wu ..... H01R 24/64
9,722,374 B2 * 8/2017 Hsu ..... H01R 27/02
2003/0123253 A1 * 7/2003 Krietzman ..... E05B 17/103 362/200
2007/0015416 A1 * 1/2007 Gutierrez ..... H01R 24/64 439/676
2012/0171898 A1 * 7/2012 Wang ..... H01R 13/6658 439/607.01

* cited by examiner

ELECTRICAL CONNECTOR HAVING A TERMINAL MODULE SUPPORTED BY AN INSULATIVE HOUSING AND A SHIELDING SHELL

BACKGROUND OF THE INVENTION

1. Field of the Invention

The present invention relates to an electrical connector including a terminal module, an insulative housing, and a shielding shell, wherein the terminal module has a front portion supported by the insulative housing and a rear portion supported by the shielding shell to obtain a firm structure.

2. Description of Related Art

China Patent No. 103457093 discloses an electrical connector comprising an insulative housing, a terminal module received by the insulative housing and having an internal printed circuit board (PCB), and a shielding shell enclosing the insulative housing and the PCB, wherein the insulative housing has a pair of restraining slots receiving a front of the insulator. U.S. Pat. No. 6,984,151 discloses an electrical connector including a pair of light emitting diodes (LEDs) mounted to an insulative housing. The LED has two leads align respectively with side slots of the insulative housing.

SUMMARY OF THE INVENTION

An electrical connector comprises: an insulative housing; a terminal module received by the insulative housing, the terminal module including an insulator, a plurality of terminals, and an internal, horizontal printed circuit board (PCB) carrying plural magnetic components; and a shielding shell enclosing the insulative housing and the PCB, wherein the insulative housing has a pair of restraining slots receiving a front of the insulator, and the shielding shell has a pair of abutting arms received between the insulator and the PCB.

DETAILED DESCRIPTION OF THE PREFERRED EMBODIMENT

Figure 1:
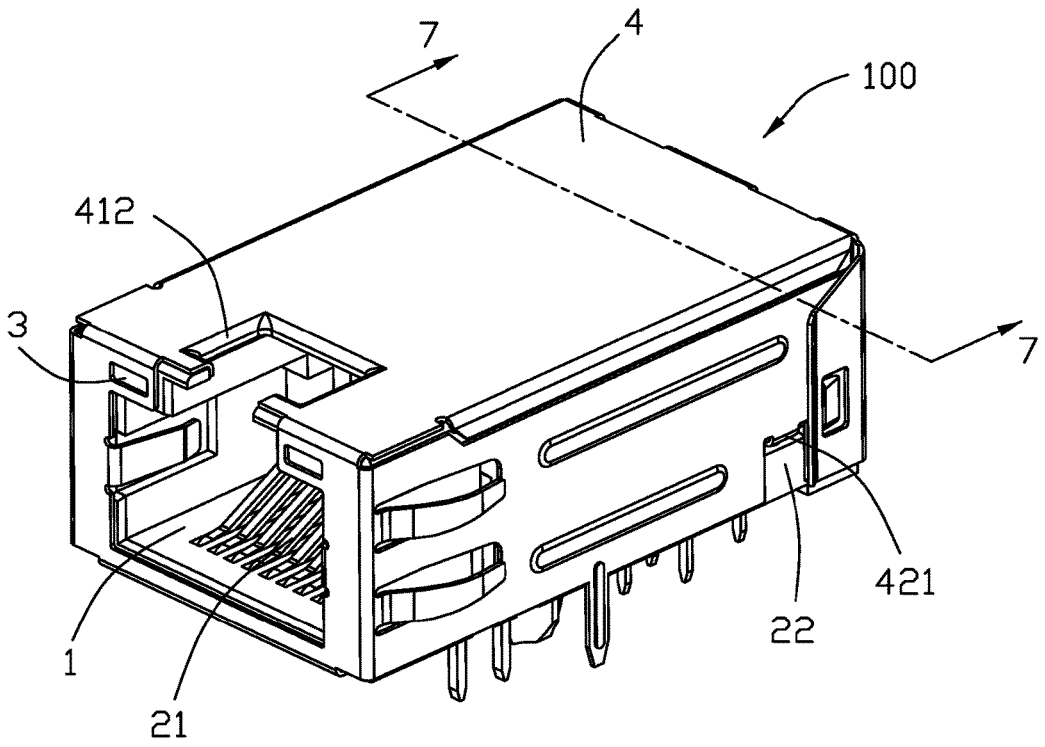
FIG. 1 is a front and top perspective view of an electrical connector in accordance with the present invention.
Figure 2:
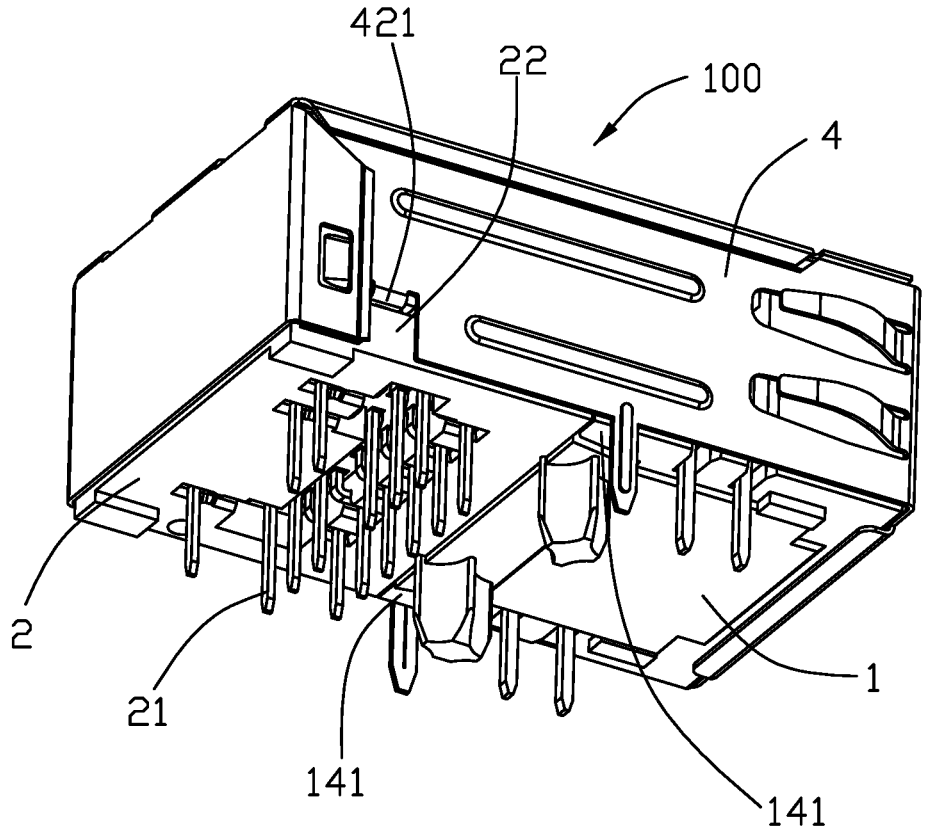
FIG. 2 is a rear and bottom perspective view of the electrical connector.
Figure 3:
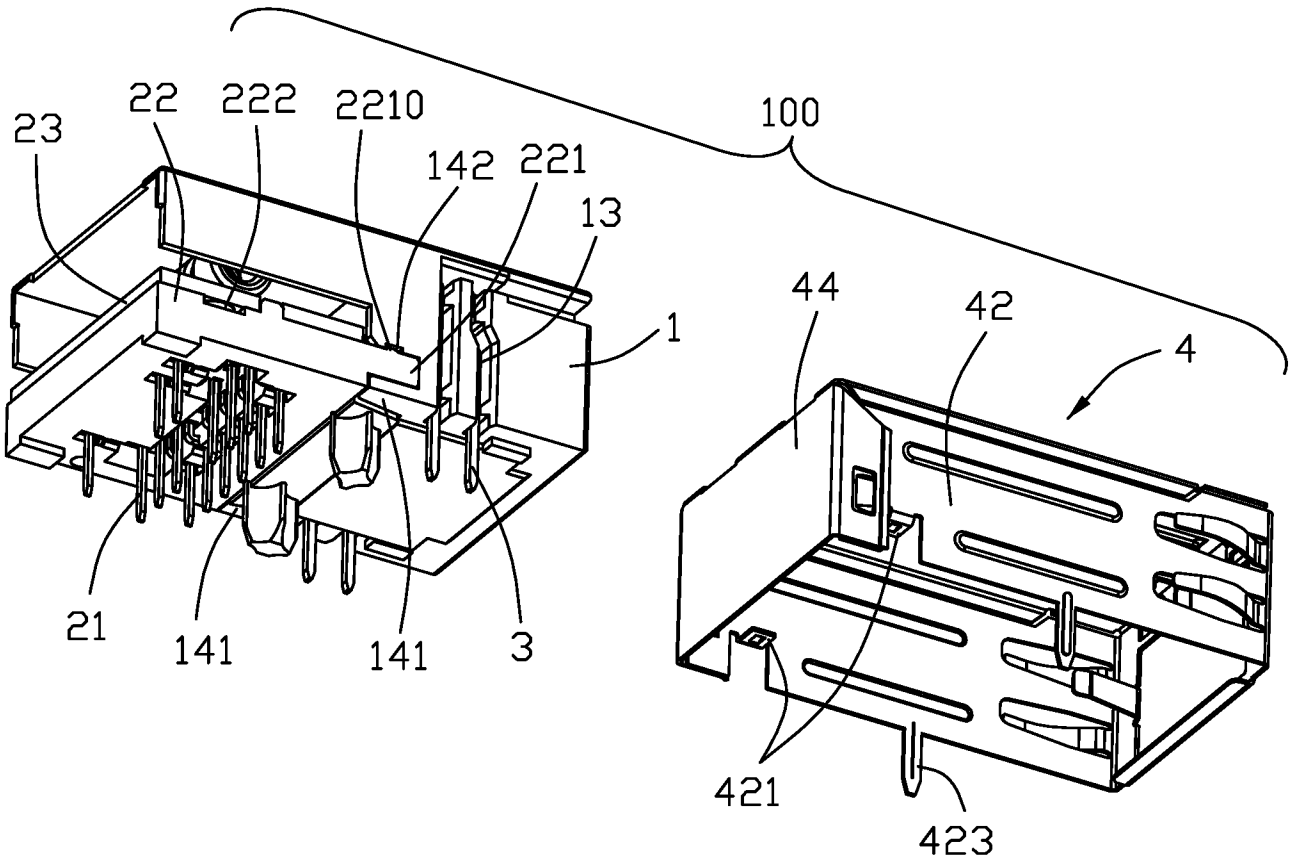
FIG. 3 is an exploded view of the electrical connector in FIG. 2.
Figure 4:
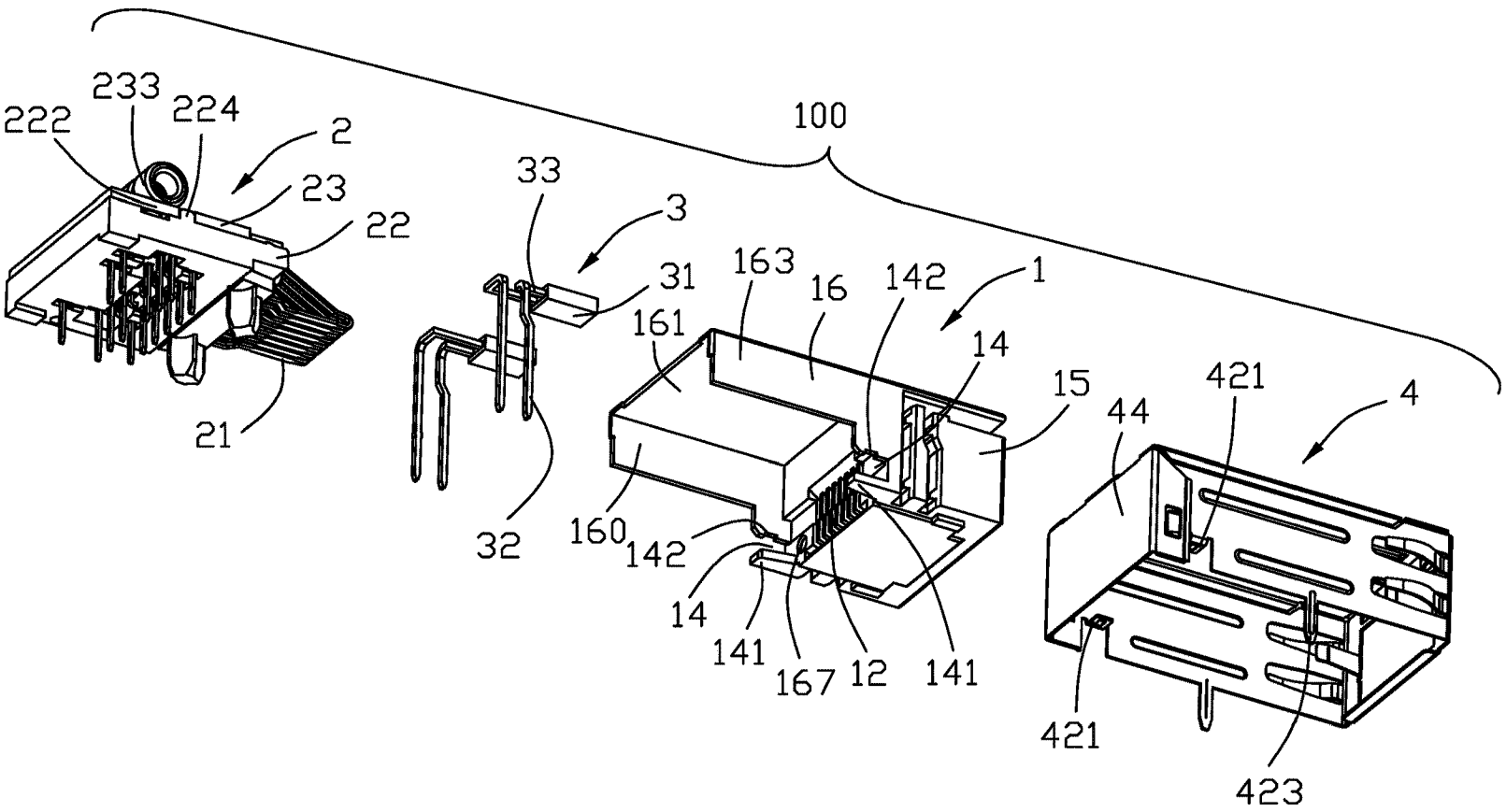
FIG. 4 is a further exploded view of the electrical connector in FIG. 3.
Figure 5:
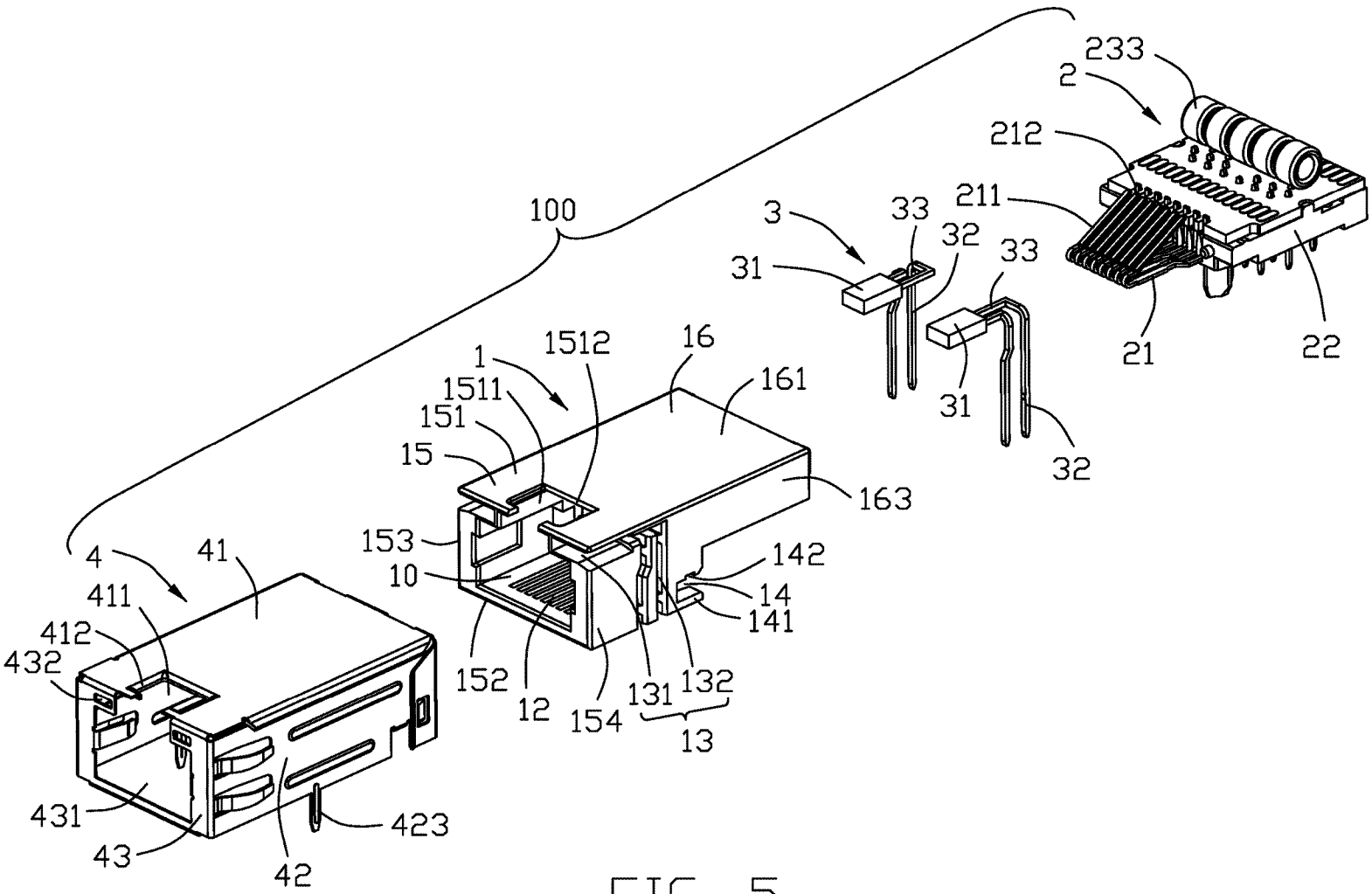
FIG. 5 is an exploded view of the electrical connector in FIG. 1.
Figure 6:
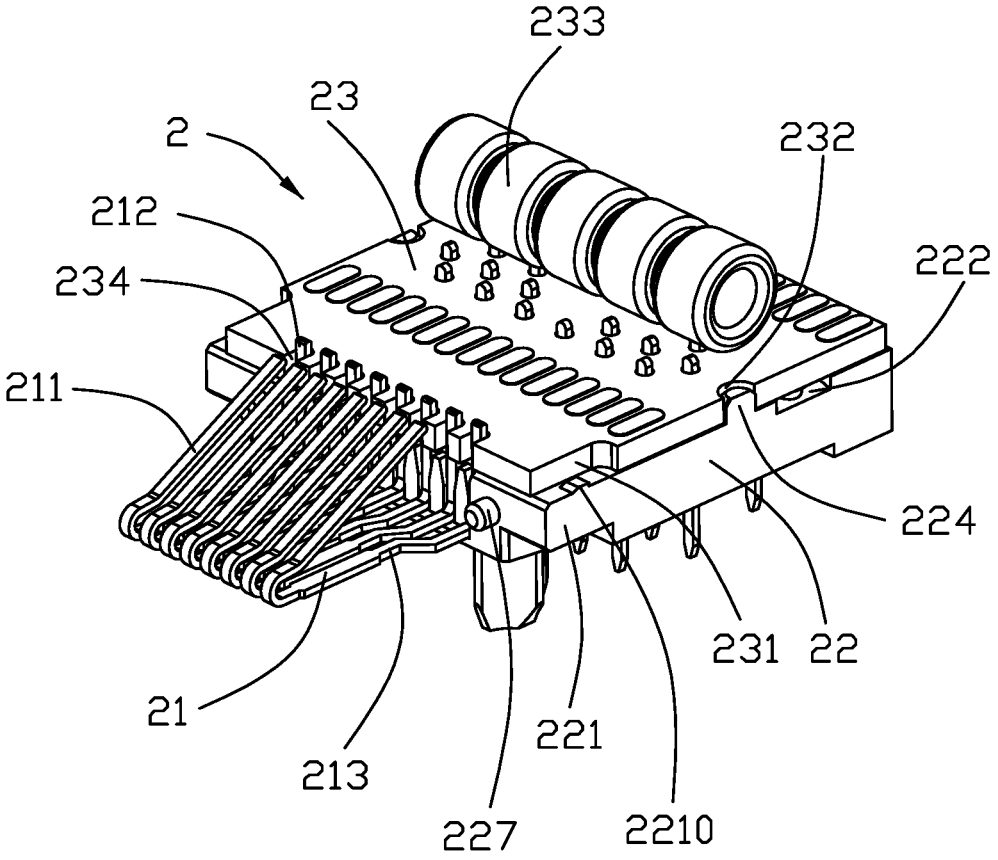
FIG. 6 is an enlarged perspective view of a terminal module of the electrical connector.
Figure 7:
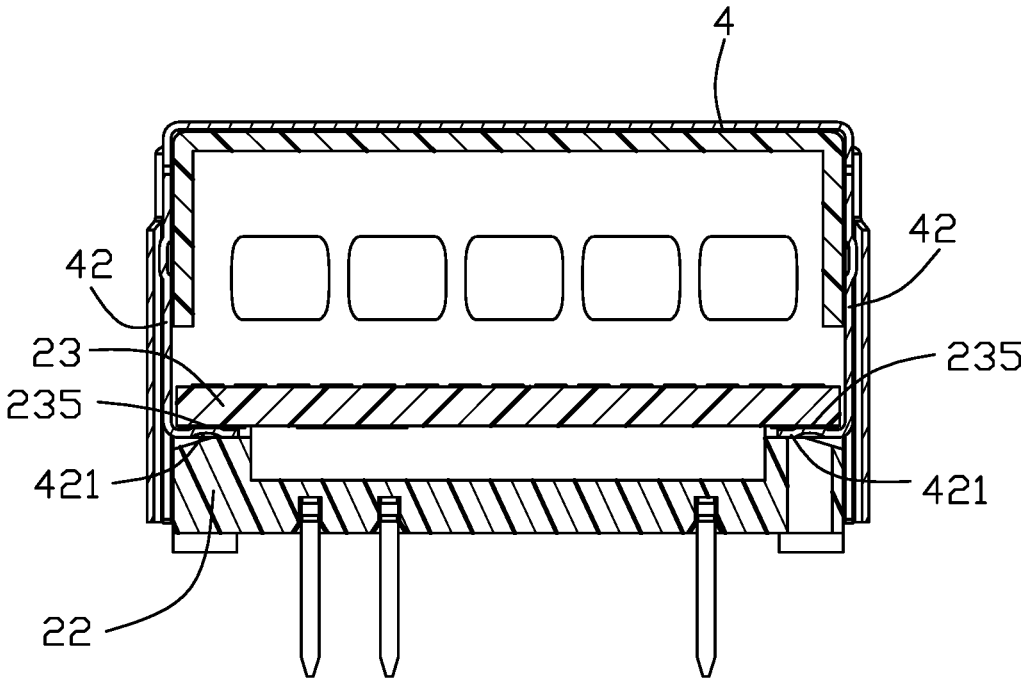
FIG. 7 is a cross-sectional view of the electrical connector taken along line A-A in FIG. 1.

Referring to FIGS. 1 to 7, an electrical connector 100 comprises an insulative housing 1, a terminal module 2 received by the insulative housing 1, and a shielding shell 4 enclosing the insulative housing 1. The electrical connector

100 may further comprise a pair of light emitting diodes (LEDs) 3 mounted to the insulative housing 1.

Referring to FIGS. 1-6, the terminal module 2 includes an insulator 22, a plurality of terminals 21 secured to the insulator 22, and an internal, horizontal printed circuit board (PCB) 23 carrying plural magnetic components 233 and mounted to the insulator 22. The terminal 21 has a contacting portion 211, a securing portion 212 secured to the insulator 22, and a connecting portion 213. The insulator 22 has a pair of front posts 227.

The insulator 22 of the terminal module 2 has a front restraining portion 221 and a rear restraining portion 222. The PCB 23 has a pair of notches 231 corresponding to the front restraining portion 221. The restraining portion 221 has a protrusion 2210. The rear restraining portion 222 includes a slot formed by recessing from an upper surface of the insulator. The PCB 23 is mounted to the insulator 22 by way of features 224 and 232. The PCB 23 further has slots 234 for the securing portions 212 of the terminals 21 to extend through and conductive pads 235 (FIG. 7) and carries magnetic components 233.

The insulative housing 1 has a base 15 defining a receiving cavity 10 and a rear mount 16. The base 15 includes a top wall 151, a bottom wall 152, two side walls 153 and 154, a notch 1511 in the top wall bordered by inner wall 1512, side grooves 13 on the side walls for accommodating the LEDs 3, and terminal-receiving grooves 12. The mount 16 includes an upper wall 161 and two side walls 163 together surrounding a receiving space 160 and a pair of restraining slots 14 each bordered in part by a lower stop 141 and an upper notch 142. The notch 142 receives the protrusion 2210. The side groove 13 has a horizontal part 131 and two vertical parts 132. The mount 16 further has a pair of holes 167 receiving the pair of posts 227 of the insulator 22.

The shielding shell 4 includes a top plate 41, two side plates 42, a front plate 43, and a rear plate 44. The front plate 43 has an opening 431 and a pair of holes 432 corresponding to the two LEDs 3. The top plate 41 has a notch 411 in communication with the opening 431. The notch 411 is bordered by a reinforced portion 412 of the top plate 41. The reinforced portion 412 covers the inner wall 1512. The shielding shell 4 has a pair of abutting arms 421, bent inward from the side plates 42, each received at the rear restraining portion 222, i.e., between the PCB 23 and the insulator 22, and contacting a corresponding conductive pad 235 for grounding purpose. The shielding shell 4 further has a pair of legs 423.

The LED 3 has a body 31 and two leads each with a horizontal portion 33 and a vertical portion 32. The body 31 and the lead horizontal portion 33 are received in the side groove horizontal part 131 and the lead vertical portions 32 are received in the side groove vertical parts 132.

In this invention, with the insulative housing restraining slots 14 receiving a front of the insulator 22 of the terminal module 2 and the shielding shell abutting arms 421 interference fitted to and therefore supporting the terminal module 2, a firm structure is obtained. Notably, the abut arm 421 may further include a vertical segment to increase resiliency during assembling. On the other hand, the two LEDs 3 are instated into the side grooves 13 in an opposite manner along a transverse direction may maintain the relative longer dimension of the housing for reinforcing consideration.

What is claimed is:

1. An electrical connector comprising:

an insulative housing;

a terminal module received by the insulative housing, the terminal module including an insulator, a plurality of terminals, and an internal, horizontal printed circuit board (PCB) fixedly positioned atop the insulator and defining opposite top and bottom surfaces in a vertical direction with plural magnetic components mounted upon the top surface; and a shielding shell enclosing the insulative housing and the PCB; wherein the insulative housing has a lower stop to support an underside of the insulator, and the shielding shell has a pair of abutting arms received between the insulator and the PCB to support a bottom surface of the PCB in the vertical direction; and the insulator has a front portion and an opposite rear portion, and the insulator is supported by the insulative housing only at the front portion.

2. The electrical connector as claimed in claim 1, wherein the abutting arms are sandwiched between the bottom surface of the PCB and a top face of the insulator.

3. The electrical connector as claimed in claim 1, wherein said housing further includes a pair of side grooves dimensioned and configured to receive therein a pair of LEDs (Light Emitting Diodes) and said side grooves are open sidewardly in a transverse direction perpendicular to said vertical direction to allow the pair of LEDs to be assembled thereinto sidewardly in said transverse direction and snugly received therein without movement in a front-to-back direction perpendicular to both said vertical direction and said transverse direction.

4. The electrical connector as claimed in claim 3, wherein said shielding shell covers said pair of side grooves sidewardly.

5. The electrical connector as claimed in claim 4, wherein each of said side grooves includes a horizontal part forwardly communicating with an exterior and a vertical part downwardly communicating with the exterior, wherein the horizontal part forms a front segment to snugly receive a body of the corresponding LED and a rear segment to snugly receive a lead horizontal portion of the corresponding LED, and the vertical part snugly receives a lead vertical portion of the corresponding LED.

6. The electrical connector as claimed 9, wherein the vertical part defines an offset structure along the front-to-back direction.

7. An electrical connector comprising:

a one-piece unitary insulative housing;

a terminal module received by the insulative housing, the terminal module including an insulator, a plurality of terminals, and an internal, horizontal printed circuit board (PCB) fixedly positioned atop the insulator and defining opposite top and bottom surfaces in a vertical direction with plural magnetic components mounted upon the top surface; and a metallic shielding shell enclosing the insulative housing and the PCB; wherein said housing further includes a pair of side grooves dimensioned and configured to receive therein a pair of LEDs (Light Emitting Diodes), and said side grooves are open sidewardly in a transverse direction perpendicular to said vertical direction and dimensioned and configured to allow the pair of LEDs to be assembled thereinto sidewardly in said transverse direction and snugly received therein without movement in a front-to-back direction perpendicular to both said vertical direction and said transverse direction; wherein the housing includes a top wall to downwardly cover the pair of LEDs without hindering sideward assembling of the LEDs into the corresponding side grooves.

8. The electrical connector as claimed in claim 7, wherein said shielding shell covers said pair of side grooves sidewardly.

9. The electrical connector as claimed in claim 8, wherein each of said side grooves includes a horizontal part forwardly communicating with an exterior and a vertical part downwardly communicating with the exterior, wherein the horizontal part forms a front segment to snugly receive a body of the corresponding LED and a rear segment to receive a lead horizontal portion of the corresponding LED, and the vertical part snugly receives a lead vertical portion of the corresponding LED.

10. The electrical connector as claimed 17, wherein the vertical part defines an offset structure along the front-to-back direction.

11. An electrical connector comprising:

an insulative housing;

a terminal module received by the insulative housing, the terminal module including an insulator, a plurality of terminals, and an internal, horizontal printed circuit board (PCB) fixedly positioned atop the insulator and defining opposite top and bottom surfaces in a vertical direction with plural magnetic components mounted upon the top surface; and a metallic shielding shell enclosing the insulative housing and the PCB; wherein said housing further includes a pair of side grooves dimensioned and configured to receive therein a pair of LEDs (Light Emitting Diodes), and said side grooves are open sidewardly in a transverse direction perpendicular to said vertical direction and dimensioned and configured to allow the pair of LEDs to be assembled thereinto sidewardly in said transverse direction and snugly received therein without movement in a front-to-back direction perpendicular to both said vertical direction and said transverse direction; wherein each of said pair of LEDs includes a body with an inner lead and an outer lead extending rearwardly therefrom, each of said inner lead and said outer lead including a lead horizontal portion extending rearwardly from the body and a lead vertical portion respectively extending downwardly from the lead horizontal portion, the lead horizontal portions of said inner lead and said outer lead being located in a same horizontal plane, the lead vertical portions of said inner lead and said outer lead being located in a same vertical plane by means of the lead horizontal portion of the inner lead extending toward the outer lead; wherein in each of said pair of LEDs, the lead vertical portion of said outer lead forms an offset structure along the front-to-back direction.

12. The electrical connector as claimed in claim 11, wherein said shielding shell covers said pair of side grooves sidewardly.

13. The electrical connector as claimed in claim 12; wherein each of said side grooves includes a horizontal part forwardly communicating with an exterior and a vertical part downwardly communicating with the exterior, wherein the horizontal part forms a front segment to snugly receive the body of the corresponding LED and a rear segment to receive the lead horizontal portion of the corresponding LED, and the vertical part snugly receives the lead vertical portion of the corresponding LED.

14. The electrical connector as claimed in claim 13, wherein each of said side grooves includes two said vertical parts to snugly receive the lead vertical portions of said two leads of the corresponding LED, respectively.

15. The electrical connector as claimed in claim 11, wherein in each of said pair of LEDs, the lead vertical portion of an inner lead of said two leads extends straightly without the offset structure.

16. The electrical connector as claimed in claim 11, wherein the housing is unitary one-piece and includes a top wall downwardly covering the pair of LEDs.

* * * * *